US005216986A

United States Patent [19]

Ohsawa et al.

[11] Patent Number: 5,216,986

[45] Date of Patent: Jun. 8, 1993

[54] V-ENGINE CONSTRUCTION

[75] Inventors: Hiroshi Ohsawa; Yuzi Yoshikawa, both of Shizuoka, Japan

[73] Assignee: Suzuki Motor Corporation, Shizuoka, Japan

[21] Appl. No.: 775,817

[22] Filed: Oct. 11, 1991

[30] Foreign Application Priority Data

Oct. 31, 1990 [JP] Japan ..... 2-294465
Dec. 30, 1990 [JP] Japan ..... 2-416712
Mar. 20, 1991 [JP] Japan ..... 3-24830[U]

[51] Int. Cl.[5] ..... F02B 75/18

[52] U.S. Cl. ..... 123/52 MV; 123/41.1; 123/55 VS

[58] Field of Search ..... 123/41.1, 41.44, 55 VS, 123/55 VF, 55 VE, 52 MV

[56] References Cited

U.S. PATENT DOCUMENTS 4,565,163 1/1986 Ishimi et al. ..... 123/41.44
5,035,207 7/1991 Sakurai et al. ..... 123/41.1

FOREIGN PATENT DOCUMENTS 0219351 4/1987 European Pat. Off. .
0282808 9/1988 European Pat. Off. .
62-69034 4/1987 Japan .
62-91615 4/1987 Japan .
62-84635 5/1987 Japan .

*Primary Examiner*—Noah P. Kamen
*Attorney, Agent, or Firm*—Flynn, Thiel, Boutell & Tanis

[57] ABSTRACT

A V-engine for permitting the engine to be more compact and easy to assemble and to improve engine cooling performance. In a first embodiment, the branch pipes of the intake manifold of the engine extend at an acute inclined angle with respect to the centerline of the crankshaft. This inclined arrangement provides a space through which the cooling water intake pipe and the cooling water discharging pipe can extend. In a second embodiment, the surge tanks of the intake manifold are longitudinally offset to provide spaces in which the thermohousing of the thermostat mounted on the cooling water intake pipe and the cooling water discharging pipe can be mounted. In a third embodiment the axis of an auxiliary machine, such as a generator, is laterally offset from the centerline of the engine crankshaft to provide a gap and the cooling water pipe extends through the gap.

3 Claims, 9 Drawing Sheets

V-ENGINE CONSTRUCTION

FIELD OF THE INVENTION

This invention relates to improvements in V-engine constructions.

BACKGROUND OF THE INVENTION

Description of the Prior Art

There are various types of engines which are classified based on the arrangement of their cylinders, such as engines with cylinders connected in-line, engines with cylinders connected in opposed states, V-shaped engines, etc.

In V-engine constructions, the first and second cylinder heads are placed on the upper surface portions of a V-shaped cylinder block, thereby forming first and second cylinder banks arranged in a V-shape.

A space or open zone, hereinafter sometimes referred to as the "V-bank space", is formed between the first and second cylinder banks forming the upper part of the V-engine, and an intake manifold is disposed in this space.

Further, as a cooling water system for a V-engine, there is disclosed in Japanese Utility Model Laid-open Publication No. Sho 62-91615, a system in which a water pump is adapted to feed cooling water to water jackets formed on each of a pair of banks of a V-engine. The pump is disposed on one side, in the crankshaft directions of the pair of banks, in such a manner that an intake port of the pump faces the V-bank space. A collecting pipe adapted to receive cooling water from the water jackets and feed same toward the radiator is disposed on the other side in the crankshaft directions of the banks. The collecting pipe is integrally formed with a valve casing adapted to accommodate therein a thermovalve which is mounted on the downstream side of the radiator such that an outlet port of the casing faces toward the V-bank space side. A connecting valve adapted to interconnect the outlet port and the inlet port is disposed within the V-bank space.

In a cooling water system of a conventional V-engine, as shown in FIG. 8, a plurality of branch pipes 124 of an intake manifold 120, which manifold is disposed in the V-bank space portion 114 of a V-engine 102, are disposed in such a manner as to extend perpendicularly to the centerline A of the V-engine 102. Owing to the foregoing arrangement, the cooling water intake pipe 126 and the cooling water discharging pipe 128 cannot be disposed within the space portion 114; rather the cooling water intake pipe 126 and the cooling water discharging pipe 128 are formed as separate bodies, respectively, the cooling water intake pipe 126 being extended from an intermediate part of one longitudinal end (left-hand side in FIG. 8) of the V-engine 102 toward one vertical side (upper side in FIG. 8) thereof, the cooling water discharging pipe 128 being extended from the other longitudinal end (right-hand side in FIG. 8) portion to the first-named longitudinal end (left-hand side in FIG. 8) of the V-engine 102 via the other vertical side (lower side in FIG. 8) of the V-engine 102.

As a result, the cooling water discharging pipe 128 extends through the outside portion from the V-engine 102 and the size of the V-engine is thereby increased, which is disadvantageous in practical use. In addition, the appearance of the V-engine is degraded.

Further, since the cooling water intake pipe 126 and the cooling water discharging pipe 128 must be manufactured as separate bodies, the manufacturing costs of the cooling water intake pipe 126 and the cooling water discharging pipe 128 are increased, which is economically disadvantageous.

When the V-engine is of the type that is placed in a vertical state and used in a FR (front engine/rear drive) vehicle, it is difficult to obtain sufficient space for installing cooling water pipes, such as the cooling water intake pipe, the thermohousing, the cooling water discharging pipe, etc. within the space that is formed between a pair of the inclined cylinder banks.

That is, in a vertical V-engine, a radiator is separately disposed in the front part of the cylinder block and the water pump is also disposed in the front part of the cylinder block. Cooling water is introduced into the water pump through the cooling water intake pipe which is connected with the radiator and then the cooling water is caused to flow into the pair of cylinder heads from the cylinder block. Then, it is flowed into a collecting pipe disposed at the rear part (transmission side) of the cylinder block via each of the cylinder heads and is returned to the radiator disposed at the front part of the cylinder block through the cooling water discharging pipe that communicates with the collecting portion.

However, an intake manifold is located in the space portion formed between the cylinder banks of the V-engine. This intake manifold is disposed close to the cylinder block in such a manner that its pair of side surge tanks, which communicate with the pair of cylinder heads through side branch pipes, are located at the lower part of the space.

Because of the foregoing arrangement, it was difficult to obtain space for installing therein the thermohousing which is mounted on the cooling water intake pipe and the cooling water discharging pipe communicating with the collecting pipe within the space formed between the cylinder banks.

The cooling water discharging pipe can be disposed at the outside of the cylinder block in such a manner as to extend in the crankshaft direction or the cooling water intake pipe can be disposed in a space at a lower part of an intake manifold as disclosed in the above-mentioned publication.

However, the arrangement for disposing the cooling water discharging pipe at the outside of the cylinder block has the inconveniences that since the cooling water intake pipe must be separately disposed, the cooling water pipings must be manufactured as separate bodies, the cost and weight thereof are increased, a compact structure is not obtainable, and the appearance is degraded.

When a cooling water intake pipe is disposed in a space at a lower part of the intake manifold, as disclosed in the above-mentioned publication, the structure can be made compact to some extent. However, in this publication, since the thermohousing is disposed in such a manner as to project outwardly from the collecting pipe and the cooling water discharging pipe is disposed at the outside of the cylinder block, it is difficult to make the whole structure sufficiently compact and, in addition, the appearance is degraded. Further, in this publication, in order to avoid interference between the end portion of the cylinder block on the other side in the crankshaft direction and the surge tank and the communicating portion with respect to the collecting pipe of the cooling water intake pipe, the cooling water intake pipe is required to be disposed in such a manner as to be separated upwardly away from the cylinder block. This means that the installation space for the intake manifold is reduced. As a result, there are the inconveniences that because the intake manifold projects outwardly from the space formed between the side cylinder banks, the structure cannot be compact and the capacity of the surge tank disposed at the intake manifold is reduced.

In the V-engine, as shown in FIG. 9, first and second cylinder heads 310-1, 310-2 and first and second cylinder head covers 312-1, 312-2 are placed on upper surface portions of a V-shaped cylinder block 304, respectively, thereby forming first and second cylinder banks 314-1, 314-2 in a V-shape.

A space 316 is formed between the first and second cylinder banks 314-1, 314-2 at the upper part of the V-engine 302, and an intake manifold (not shown) and an auxiliary apparatus disposed across the first and second cylinder heads 310-1, 310-2 are arranged in this space.

As a structure for arranging auxiliary apparatus in a V-engine, Japanese Utility Model Early Laid-open Publication No. Sho 62-84635 discloses one which is designed such that in a V-engine, a crank pulley is mounted on an outer side of one end of an engine body in the crankshaft direction thereof and a transmission casing is mounted on the outer side of the other end thereof. An intake manifold is disposed in the space which is formed between the pair of banks of the engine body. The intake manifold, with a throttle body mounted thereon expanded toward an upper space of the transmission casing, is disposed in such a manner as to be extend toward the transmission casing in the V-bank space in order to form a space, on the crank pulley side, where no intake manifold is present. An auxiliary apparatus driven through the crank pulley is disposed in this space.

Furthermore, there is disclosed in Japanese Utility Model Early Laid-open Publication No. Sho 62-69034, a V-engine comprising two sets of cylinder rows formed by arranging individual cylinders in series and connected in a V-shape at a predetermined bank angle. An auxiliary machine part, including a driven pulley, is disposed in the V-valley portion and is accommodated in the center of an upper side of the cylinder block which accommodate the two sets of cylinder rows. The driven pulley is driven by the crankshaft through a belt drive system.

In the conventional structure of an auxiliary apparatus for a V-engine, as shown in FIG. 9, a generator 344 as an auxiliary apparatus is disposed in the space 316 of the V-engine 302 such that the center C1 of the V-engine 302 and the center C2 of the generator 344 are vertically aligned, that is, they both lie in the same imaginary vertical plane.

A cooling water pipe 342 is disposed in the vicinity of the intake manifold on both sides of the V-engine 302 in such a fashion as to project outward.

As a result, when the V-engine 302 is driven, the cooling water pipe 342 is heated by the heat of an exhaust manifold 356 and the cooling efficiency of the cooling water is lowered, which is inconvenient in practical use.

To avoid the above inconvenience, there was encountered another inconvenience in that the radiator (not shown) must be made large in size.

Further, since the generator, as an auxiliary apparatus, is disposed in the space 316 of the V-engine 302 in order to bring the center of the V-engine 302 to be coincident with the center of the generator 344, it is impossible to use this space 316 efficiently to lay out other auxiliary machines therein, which is disadvantageous in practical use.

Furthermore, since the cooling water pipe 342 projects outwardly when the V-engine 302 is mounted, there was the additional inconvenience that the workability of the mounting operation of the V-engine 302 was diminished and the cooling water pipe 342 is likely to get damaged, which is disadvantageous in practical use.

SUMMARY OF THE INVENTION

In order to obviate the above inconveniences, the object of the first embodiment of the present invention is to provide a cooling water system for a V-engine, in which, when viewed from above, the branch pipes of the intake manifold of the V-engine are inclined at a predetermined angle less than 90° so to extend non-perpendicularly to the centerline or axis of rotation of the crankshaft. The cooling water intake pipe and the cooling water discharging pipe are disposed within the space defined by the inclined arrangement of the branch pipes, thereby making it possible to make the V-engine compact, to integrally form the cooling water intake pipe with the cooling water discharging pipe and to reduce the manufacturing costs of the cooling water intake pipe and the cooling water discharging pipe.

In order to achieve this object, in the first embodiment of the present invention there is provided a cooling water system for a V-engine in which (1) the cooling water intake pipe adapted to form a cooling water intake conduit intercommunicating the radiator and the water pump, and (2) the cooling water discharging pipe adapted to form a cooling water discharging conduit communicating with the water pump in order to return the cooling water which has passed through the water pump to the radiator from each cylinder head, are disposed at the upper portion of the V-engine on which the intake manifold is disposed, with the branch pipes of the intake manifold of the V-engine being inclined at a predetermined angle so as to be non-perpendicular to the centerline of the crankshaft, and the cooling water intake pipe and the cooling water discharging pipe being disposed within the space defined by the inclined arrangement of the branch pipes.

Owing to the above-mentioned first embodiment of the present invention, when the V-engine is operated, cooling water cooled by the radiator flows into the water pump after passing through the cooling water intake pipe, and then is fed under pressure into the respective cylinder heads of the V-engine by this water pump to cool the V-engine. Thereafter, the cooling water is fed again to the radiator by the cooling water discharging channel.

In the second embodiment of the present invention, there is provided a structure of a cooling water system for a V-engine in which (1) the cooling water intake pipe which is adapted to supply cooling water coming from the radiator to a water pump, which cooling water intake pipe is located on one side in the crankshaft direction, and (2) the cooling water discharging pipe which is adapted to return cooling water collected within a collecting pipe which is located on the other side in the crankshaft direction via each of a pair of side cylinder heads of said V-engine, are disposed in the space which is formed between the pair of side cylinder banks of said V-engine. An intake manifold including a pair of side surge tanks communicates with the side cylinder heads of the V-engine through a pair of said branch pipes. Extra spaces are formed in said one side and the other side within said space by arranging the pair of side surge tanks such that they are longitudinally offset from each other in the crankshaft direction. A thermohousing adapted to accommodate a thermostat mounted on the cooling water intake pipe and the cooling water discharging pipe are disposed in said extra spaces, respectively.

By virtue of the foregoing construction, the thermohousing mounted on the cooling water intake pipe and the cooling water discharging pipe are disposed in the extra spaces which are formed by arranging the side surge tanks of the V-engine in such a manner as to be longitudinally offset from each other in the crankshaft direction. Accordingly, the cooling water discharging pipe is not required to be disposed in such a manner as to be separated upwardly away from the cylinder block in order to avoid interference between the end portion of the cylinder block on the other side in the crankshaft direction and the surge tank and the communicating portion of the cooling water discharging pipe. Furthermore, since the installation space for the intake manifold is not reduced, the cooling water pipes can be installed in a compact manner.

In the third embodiment of the invention there is provided a V-engine having a cylinder block on which first and second cylinder banks are arranged in a V-shape. A cooling water pipe is disposed between the cylinder block of the V-engine and an intake manifold. An auxiliary apparatus is disposed in such a manner as to be laterally offset with respect to the centerline of the V-engine, the cooling water pipe being taken out through the gap portion generated by the lateral offsetting of the auxiliary apparatus.

With the above construction, the auxiliary apparatus is disposed in such a manner as to be laterally offset with respect to the center of the V-engine in order to define a gap portion when the V-engine is assembled. The cooling water pipe is disposed between the cylinder block of the V-engine. The cooling water pipe is taken out through this gap portion.

DETAILED DESCRIPTION

The present invention will be described in detail hereinafter with reference to the drawings.

Figure 1:
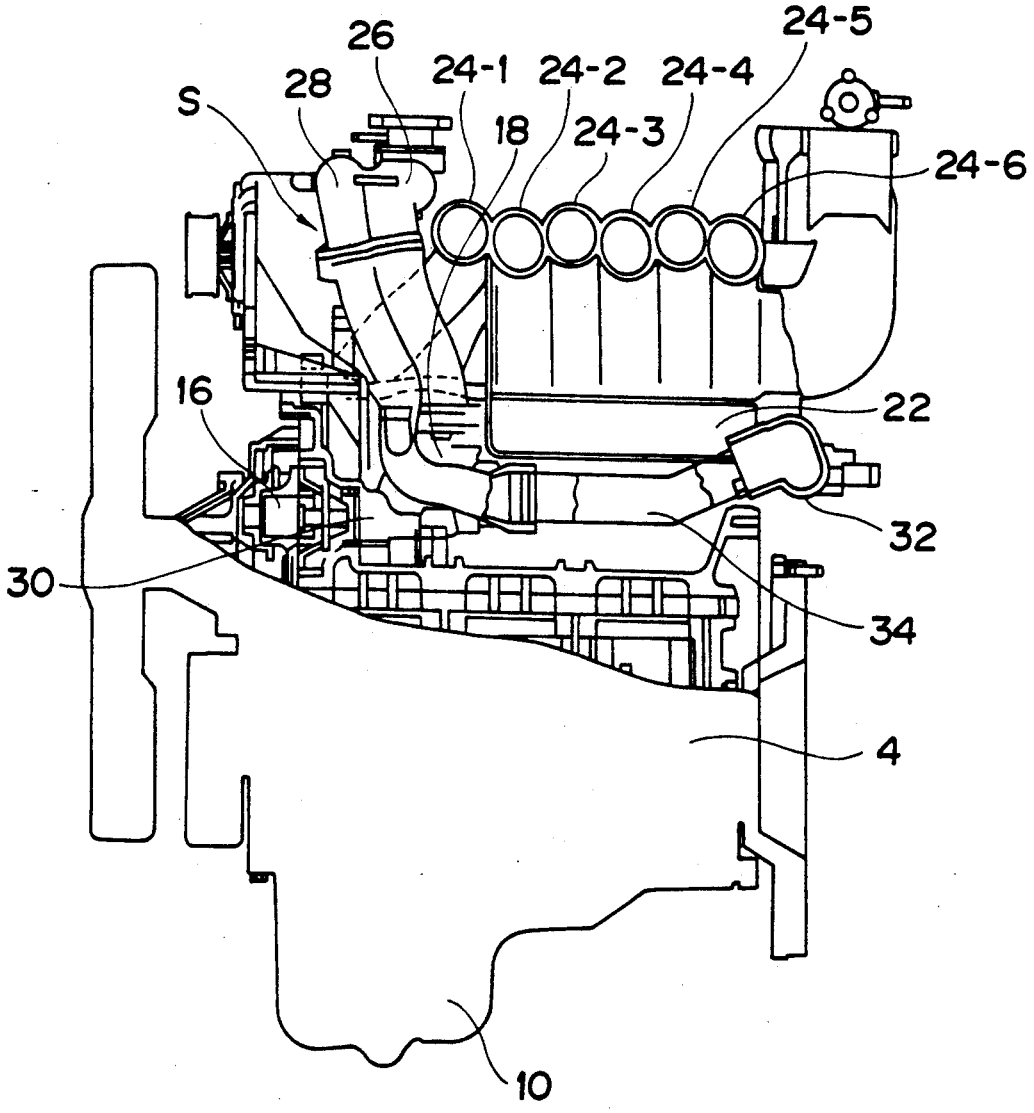
FIG. 1 is a schematic side view of a V-engine incorporating the first embodiment of the invention.
Figure 2:
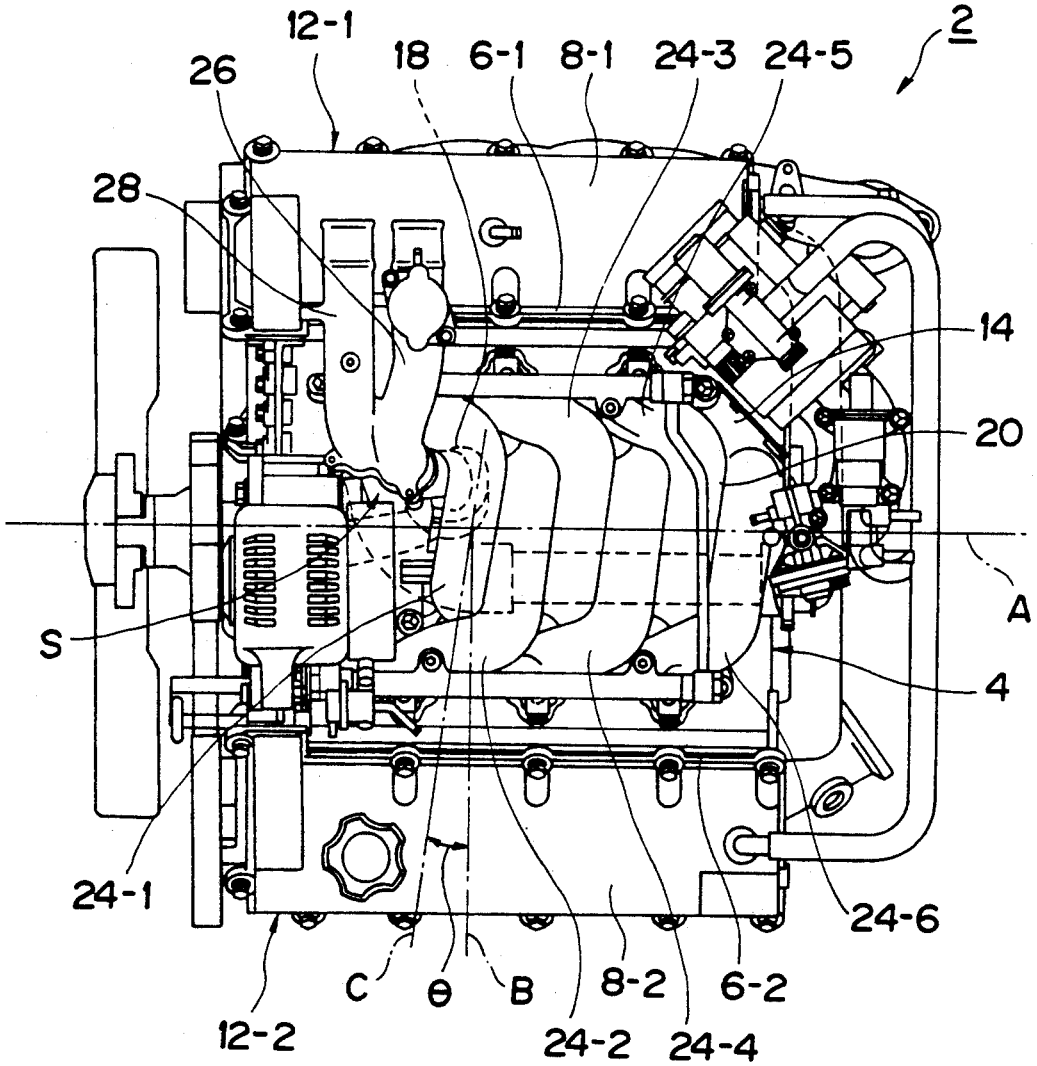
FIG. 2 is a schematic top view of the engine of FIG. 1.

FIGS. 1 and 2 illustrate the first embodiment of the present invention. In FIG. 2, the numeral 2 denotes a six-cylinder V-shaped internal combustion engine (hereinafter referred to as the "V-engine"), 4 denotes a cylinder block, 6-1 and 6-2 denote cylinder heads, and 8-1 and 8-2 denote cylinder head covers, respectively. In the V-engine 2, an oil pan 10 (FIG. 1) is attached to the lower surface of the V-cylinder block 4, and the first and second cylinder heads 6-1, 6-2 and first and second cylinder head covers 8-1, 8-2 are mounted on the upper surfaces of the V-cylinder block 4. The first cylinder head 6-1 and the first cylinder head cover 8-1 are disposed on one side (upper side of FIG. 2) of the longitudinal axis of the V-engine 2, while the second cylinder head 6-2 and the second cylinder head cover 8-2 are disposed on the other side (lower side of FIG. 2) of the longitudinal axis of the V-engine 2. By thus placing the first and second cylinder heads 6-1 and 6-2, there are provided first and second, opposed, cylinder banks 12-1 and 12-2 which are inclined so that they form a V-shaped angle, and a space 14 is provided between the first and second cylinder banks 12-1 and 12-2.

A water pump 16 is disposed in the space 14 and is located at the front part of the V-engine (the left hand side in FIGS. 1 and 2). A thermostat 18 and an intake manifold 20 are disposed in the vicinity of the water pump 16. The intake manifold 20 comprises a common or collecting portion 22 and first through sixth branch pipes 24-1 through 24-6 branched from the collecting portion 22 and extending substantially horizontally.

Further, the first through sixth branch pipes 24-1 through 24-6 are inclined at a predetermined angle $\theta$ (FIG. 2) relative to a vertical plane passing perpendicularly through the centerline A of the crankshaft so as to be non-perpendicular to the centerline A of the crankshaft. A cooling water intake pipe 26 and a cooling water discharging pipe 28 are disposed in a space S which is defined by the inclined arrangement of the first through sixth branch pipes 24-1 through 24-6.

The first through sixth branch pipes 24-1 through 24-6 are inclined at a predetermined angle $\theta$ with respect to the centerline A only in the forward and rearward direction of the V-engine 2. That is, when viewed from above, as in FIG. 2, the branch pipes 24-1 through 24-6 are inclined at angle $\theta$ relative to centerline A. More specifically, as is shown in FIG. 2, the centerline C of the first branch pipe 24-1 of the intake manifold 20 is inclined at the predetermined angle $\theta$ with respect to a imaginary line B which is perpendicular to the centerline A or axis of rotation of the crankshaft of the V-engine 2, wherein the centerline A extends from one end (left-hand side of FIG. 2) at the front of the V-engine 2 toward the other end (right-hand side of FIG. 2) at the rear of the V-engine 2. The second through sixth branch pipes 24-2 through 24-6 are also similarly inclined, as in the case of the first branch pipe 24-1, whereby to define the free space S at one end (left-hand side of FIG. 2) of the V-engine 2. The cooling water intake pipe 26 and the cooling water discharging pipe 28 are disposed in this space S.

The first through sixth branch pipes 24-1 through 24-6 extend at the predetermined angle $\theta$ at the point of intersection between the centerline of the first through sixth branch pipes 24-1 through 24-6 and the centerline A of the crankshaft. The cooling water intake pipe 26 is adapted to intercommunicate the radiator (not shown) and the water pump 16 through the thermostat 18. The cooling water discharging pipe 28 is adapted to intercommunicate a cooling water collecting pipe 32 communicating at the other end (right-hand side of FIG. 1) portion of the V-engine with the first and second cylinder heads 6-1 and 6-2 and the radiator (not shown), and has a cooling water discharging channel 34 formed therein.

The operation is as follows:

When the V-engine 2 is operated, the engine cooling water is cooled by the radiator (not shown), is flowed into the water pump 16 after passing through the cooling water intake pipe 26 and then is fed under pressure into the first and second cylinder heads 6-1 and 6-2 of the V-engine by the water pump 16 whereby to cool the V-engine 2. Thereafter, the cooling water is fed again to the radiator (not shown) through the cooling water discharging pipe 28.

By the disclosed inclined arrangement of branch pipes 24-1 through 24-6 and locating the pipes 26 and 28 in space S, the V-engine 2 is made more compact, which is advantageous in practical use. Moreover, the appearance of the V-engine 2 is improved.

Furthermore, since the cooling water intake pipe 26 and the cooling water discharging pipe 28 are installed in the space S, both the cooling water intake pipe 26 and the cooling water discharging pipe 28 can be integrally formed as one unit by casting, thus enabling reduction of the manufacturing cost of the cooling water intake pipe 26 and cooling water discharging pipe 28, which is advantageous in practical use.

Moreover, since the upstream side portion of the cooling water intake pipe 26 and the downstream side portion of the cooling water discharging pipe 28 are disposed at one end (left-hand side of FIG. 2) at the front part of the V-engine 2, when the vehicle is of the FR type (vehicle of front engine, rear drive design), the piping of the cooling water intake pipe 26 and the cooling water discharging pipe 28 can easily be performed, which is advantageous in practical use.

As described in detail in the foregoing, according to the first embodiment of the present invention, the branch pipes 24-1 through 24-6 of the intake manifold of the V-engine lie substantially in a common horizontal plane and are inclined at a predetermined angle so as to be non-perpendicular to the centerline A of the crankshaft. A cooling water intake pipe and a cooling water discharging pipe are disposed within the space portion created by the inclined arrangement of the branch pipes. Accordingly, the V-engine can be made compact, which is advantageous in practical use. Moreover, the appearance of the V-engine can be improved. In addition, since the cooling water intake pipe and the cooling water discharging pipe are disposed in the space S', the cooling water intake pipe and the cooling water discharging pipe can be integrally formed, and therefore, the manufacturing costs of the cooling water intake pipe and the cooling water discharging pipe can be reduced, which is advantageous in practical use.

Figure 3:
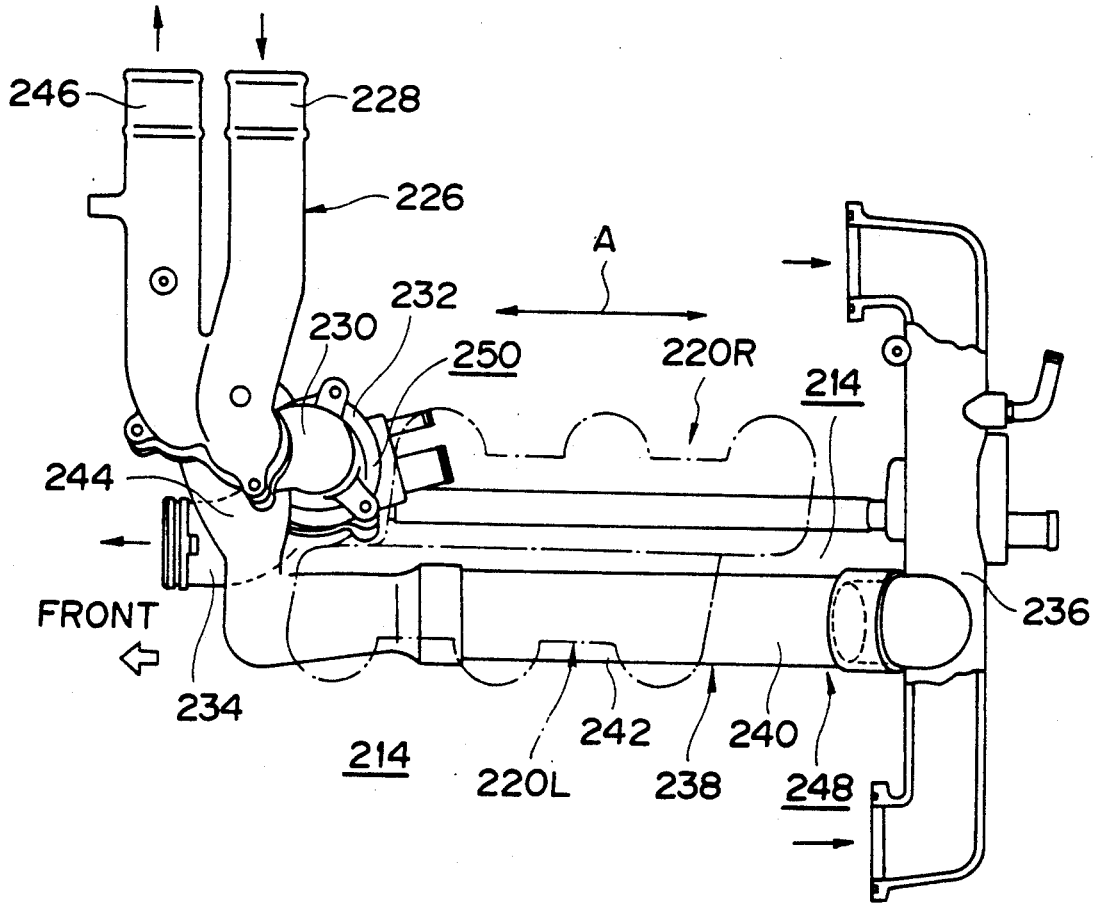
FIG. 3 is a plan view of the structure of the cooling water system for a V-type internal combustion engine, incorporating the second embodiment of the invention.
Figure 4:
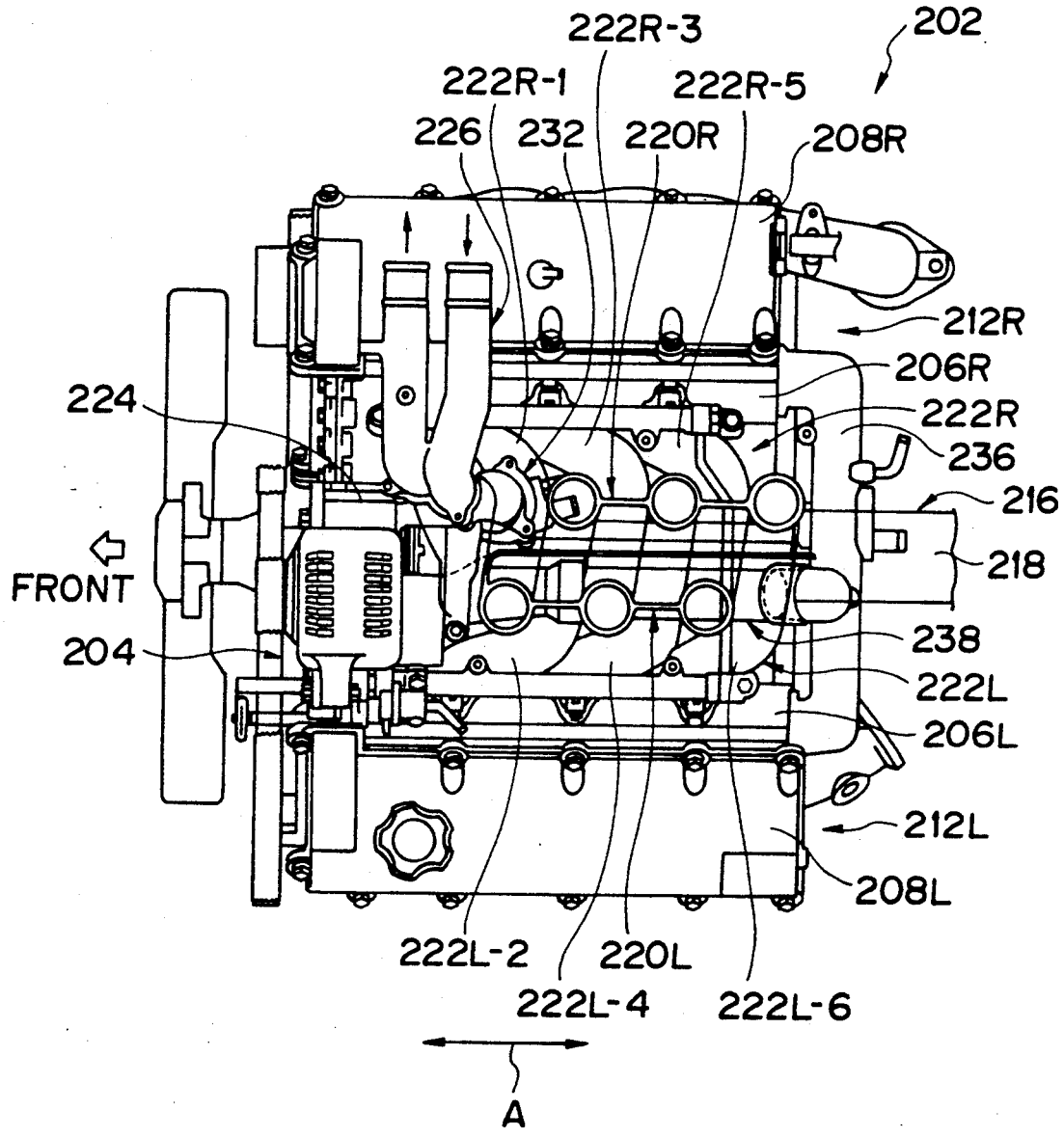
FIG. 4 is a schematic top view of an engine incorporating the cooling water system of FIG. 3.
Figure 5:
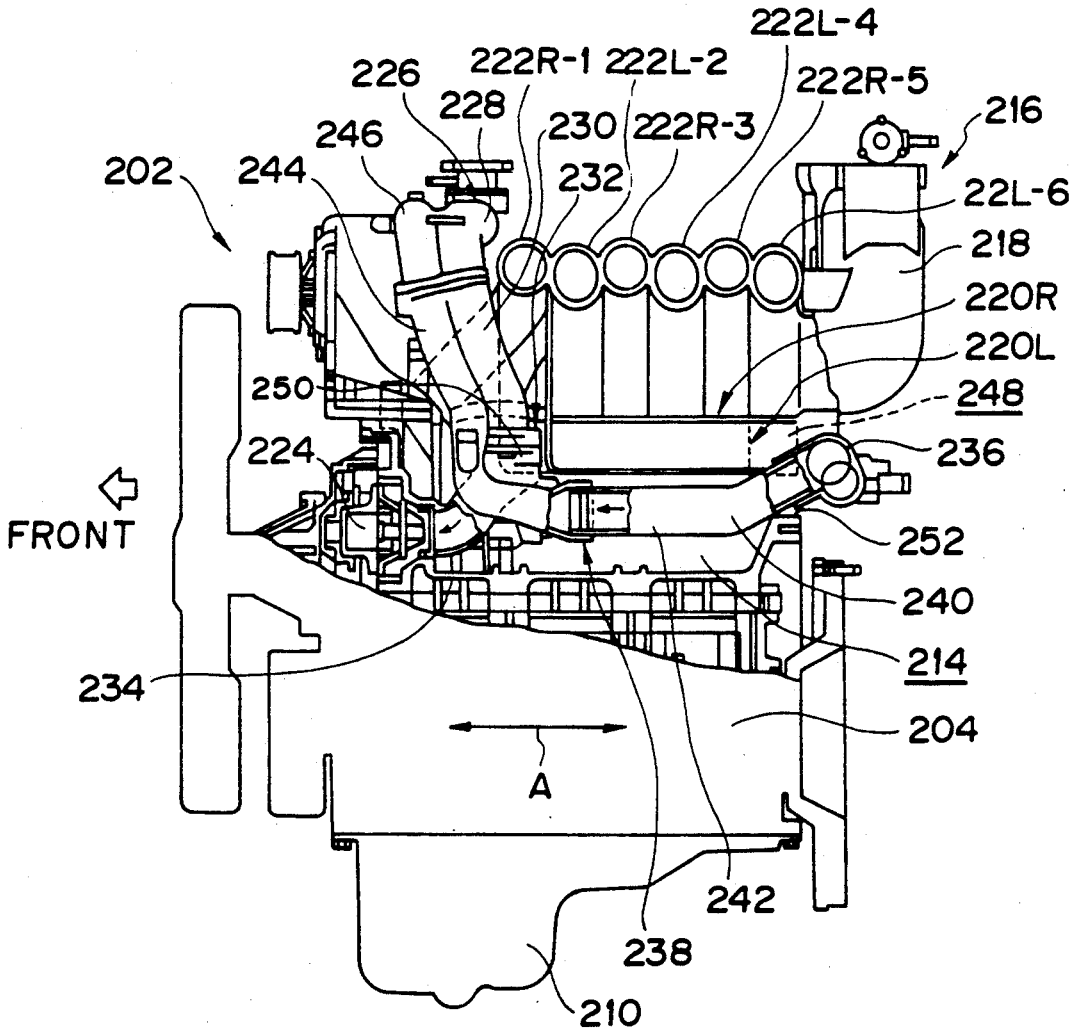
FIG. 5 is a schematic side view of the engine of FIG. 4.

FIGS. 3, 4 and 5 illustrate a second embodiment of the present invention. In FIGS. 3 and 4, the numeral 202 denotes a V-engine, 204 denotes a cylinder block, 206L and 206R denote cylinder heads, and 208L and 208R denote cylinder head covers, respectively. In the V-engine, an oil pan 210 is attached to a lower part of the V-cylinder block 204. The pair of side cylinder heads 206L, 206R and the pair of side cylinder head covers 208L, 208R are placed on an upper part of the V-cylinder block 204, respectively. One side cylinder head 206L and one side cylinder head cover 208L are disposed on one side (lower side in FIG. 4) in the width direction of the V-engine 202. The other side cylinder head 206R and the other side cylinder head cover 208R are disposed on the other side (upper side in FIG. 4) in the width direction of the V-engine 2.

In the V-engine 2, the side cylinder heads 206L, 206R are placed on the cylinder block 204 to form a pair of side cylinder banks 212L, 212R in a V-shape. A space 214 is formed between the side cylinder banks 212L, 212R.

An intake manifold 216 is disposed in the space 214. The intake manifold 216 comprises an intake pipe 218, a pair of side surge tanks 220L, 220R communicating with the intake pipe 218, and a pair of sets of side branch pipes 222L, 222R intercommunicating the side surge tanks 220L, 220R and the side cylinder heads 206L, 206R.

In this embodiment, the side branch pipes 222L, 222R comprise first, third and fifth branch pipes 222R-1, 222R-3 and 222R-5 communicating at corresponding one ends thereof with one side surge tank 220L which is located in the lower part in FIG. 4 and at the other ends thereof with first, third and fifth cylinders (not shown) disposed at the other side cylinder head 212R which is located at an upper part in FIG. 4. Second, fourth and sixth cylinders 222L-2, 222L-4 and 222L-6 communicate at corresponding one ends thereof with the other side surge tank 220R which is located at an upper part in FIG. 4 and the other ends thereof communicate with second, fourth and sixth cylinders (not shown) which are disposed in the lower part in FIG. 4.

Within the space portion 214 in which the intake manifold 218 is disposed, a water pump 224 is disposed at the front of the cylinder block 204. The front of the cylinder block 204 is one end, that is, the leftward end in FIGS. 3 and 4, of the crankshaft direction (the direction indicated by a two-headed arrow A). The water pump 224 communicates with a cooling water intake pipe 226 adapted to introduce cooling water from a radiator (not shown). The cooling water intake pipe 226 has a communicating portion 228 on one end thereof which communicates with the radiator. An intermediate converging portion 230 of the pipe 226 communicates with a converging portion 244 of the cooling water discharging pipe 238 which will be described later. A thermohousing 232 is mounted on this converging portion 230 and an introducing portion 234 on the other end thereof communicates with the water pump 224.

Cooling water fed by the water pump 224 is caused to flow through water jackets (not shown) of the side cylinder heads 206L, 206R from the front end in the crankshaft direction of the cylinder block 204. The cooling water is collected by a collecting pipe 236 disposed on the rear end in the crankshaft direction of the side cylinder heads 206L, 206R. The collecting portion 236 communicates with the cooling water discharging pipe 238 which is adapted to return the collected cooling water to the radiator. This cooling water discharging pipe 238 communicates at one end thereof with the collecting pipe 236, has an intermediate longitudinally extending portion 242 thereof in the space 214 formed at a lower part of one side surge tank 220L, and diverges to a diverging portion 246 after being converged at the converging portion 244 on the other side thereof to the converging portion 230 of the cooling water intake pipe 226 so as to be communicated with the radiator (not shown).

By being disposed in such a manner as to be longitudinally offset from each other in the crankshaft directions (the directions as indicated by the two-headed arrow A) as shown in FIG. 3, the respective side surge tanks 220L, 220R of the intake manifold 216 define extra spaces 248, 250 on one side and the other side within the space portion 214. That is, by disposing one side surge tank 220L in such a manner as to be longitudinally offset in the left direction in FIG. 3, a extra space 248 is defined at the rear and on the other side in the crankshaft directions. Similarly, by being longitudinally offset in the right direction in FIG. 1, the other side surge tank 220R defines a side extra space 250 at the front end and on the one side in the crankshaft directions.

The thermohousing 232 located at the converging portion 230 of the cooling water intake pipe 226 is disposed in the one side extra space 250 and, in addition, the converging portion 244 of the cooling water discharging pipe 238 is disposed therein. The communicating portion 240 of the cooling water discharging pipe 238 is disposed in the other side extra space 248.

Next, the operation will be described.

When the V-engine is operated, cooling water cooled by the radiator (not shown) is flowed into the water pump 224 after passing through the cooling water intake pipe 226 and the thermohousing 232. The cooling water is then fed under pressure to the water jackets (not shown) of the side cylinder heads 206L, 206R of the V-engine by the water pump 224 whereby to cool the V-engine 2. Thereafter, the cooling water is fed again to the radiator (not shown) from the collecting pipe 236 through the cooling water discharging pipe 238.

The thermohousing 232 for accommodating a thermostat (not shown) therein and the cooling water discharging pipe 238 are installed in the extra spaces 248, 250 which are defined by slightly longitudinally offsetting the side surge tanks 220L, 220R relative to each other. The side surge tanks 220L, 220R are disposed within the space portion 214 formed between the side cylinder banks 212L, 212R. The thermohousing 232 and the converging portion 244 of the cooling water discharging pipe 238 are installed in the one side extra space 250, while the communicating portion 240 of the cooling water discharging portion 238 is installed in the other side extra space 248. The capacity of each of the side surge tanks 220L, 220R is not changed and therefore, there is no fear that the power of the V-engine 202 will be reduced.

Further, in the cooling water discharging pipe 238, as shown in FIGS. 3 and 5, since there can be avoided the interference between the end portion 252 of the cylinder block at the rear end thereof and the one side surge tank 220L and the communicating portion 240, the cooling water discharging pipe 238 is not required, as is the case in the conventional structure, to be separated upwardly away from the cylinder block 204 and the installation space for the intake manifold 216 is not reduced by such separation.

Because of this, since the intake manifold 216 is not projected, outwardly the V-engine 202 can be made compact, which is advantageous in practical use. Moreover, since the cooling water pipes can be installed within the space portion 214, the appearance of the V-engine 202 is improved.

Furthermore, since the thermohousing 232 mounted on the cooling water intake pipe 226 and the converging portion 244 of the cooling water discharging pipe 238 are installed in the one side extra space 250, both the cooling water intake pipe 226 and the cooling water discharging pipe 238 can be integrally formed by casting, thus making it possible to reduce the weights of the cooling water intake pipe 226 and cooling water discharging pipe 238, which is advantageous in practical use.

Moreover, since the communicating portion 228 as an upstream side portion of the cooling water intake pipe 226 and the converging portion 244 as a downstream side portion of the cooling water discharging pipe 238 are disposed on one side (left-hand side in FIG. 4) in the crankshaft directions at the front of the V-engine 202, when the vehicle is of the FR type (vehicle of front engine, rear drive design), the piping of the cooling water intake pipe 226 and the cooling water discharging pipe 238 can easily be performed, which is advantageous in practical use.

Figure 6:
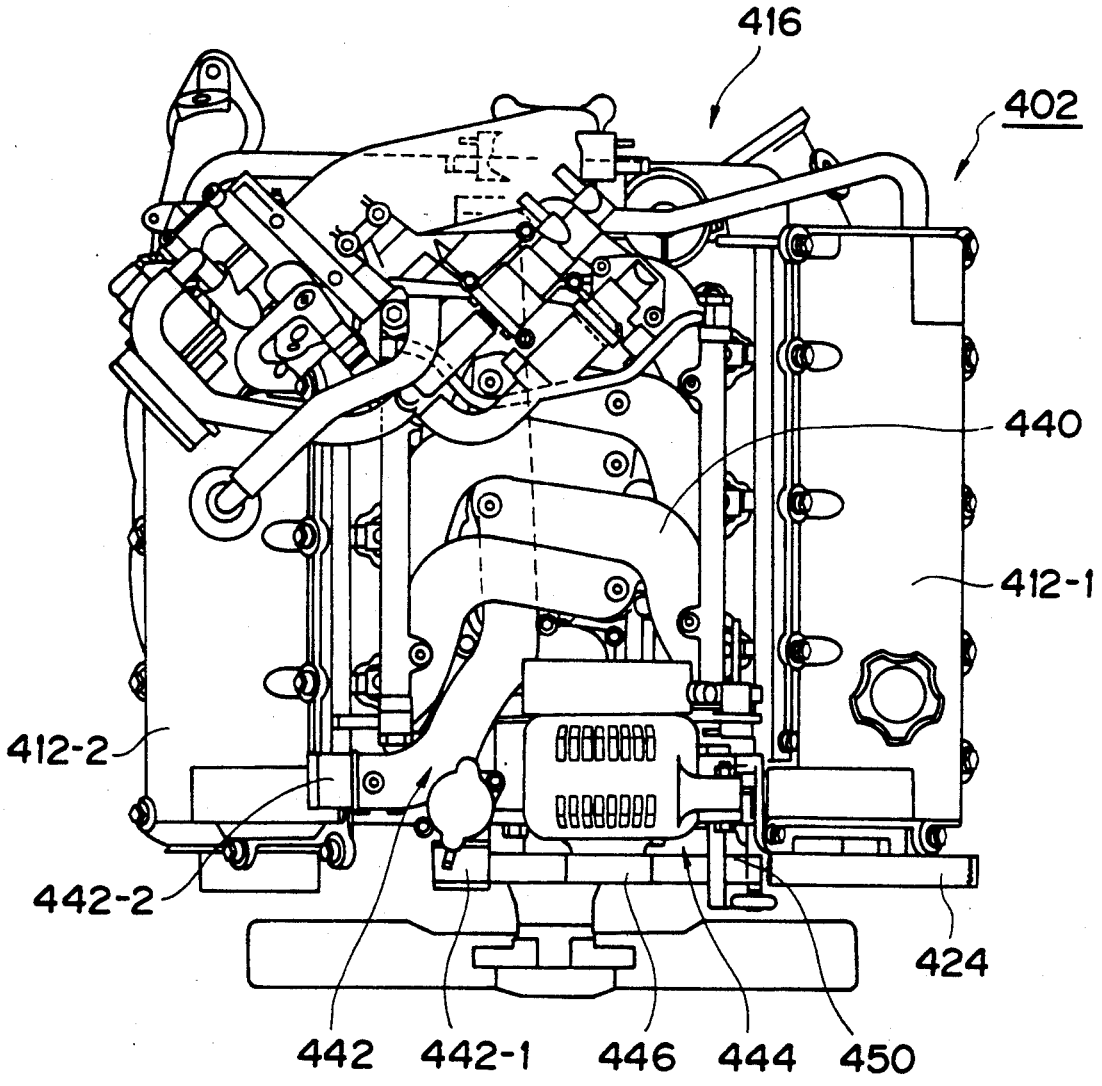
FIG. 6 is a schematic top view of the engine incorporating the third embodiment of the invention.
Figure 7:
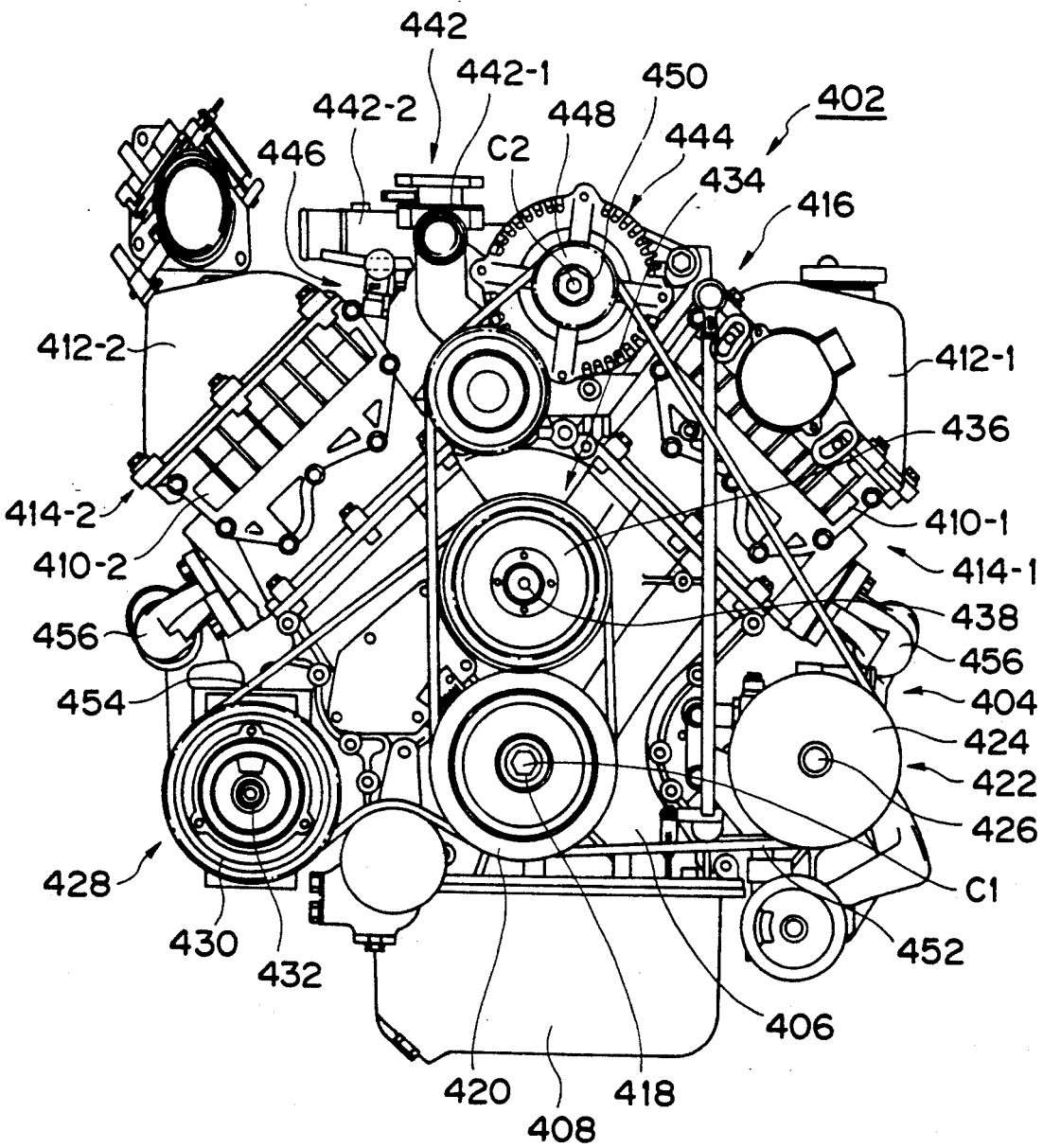
FIG. 7 is a schematic front view of the engine of FIG. 6.
Figure 8:
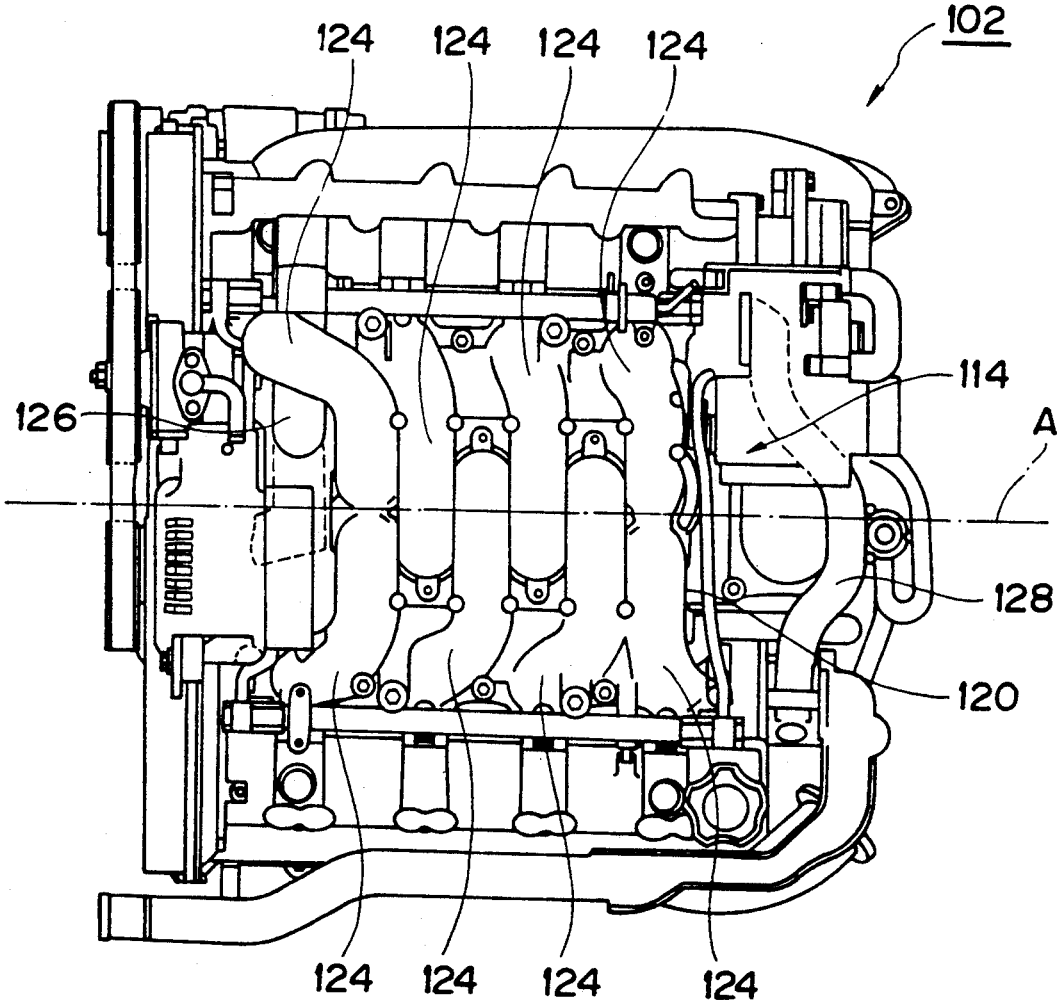
FIG. 8 PRIOR ART
FIG. 8 is a schematic top view of a prior art engine.
Figure 9:
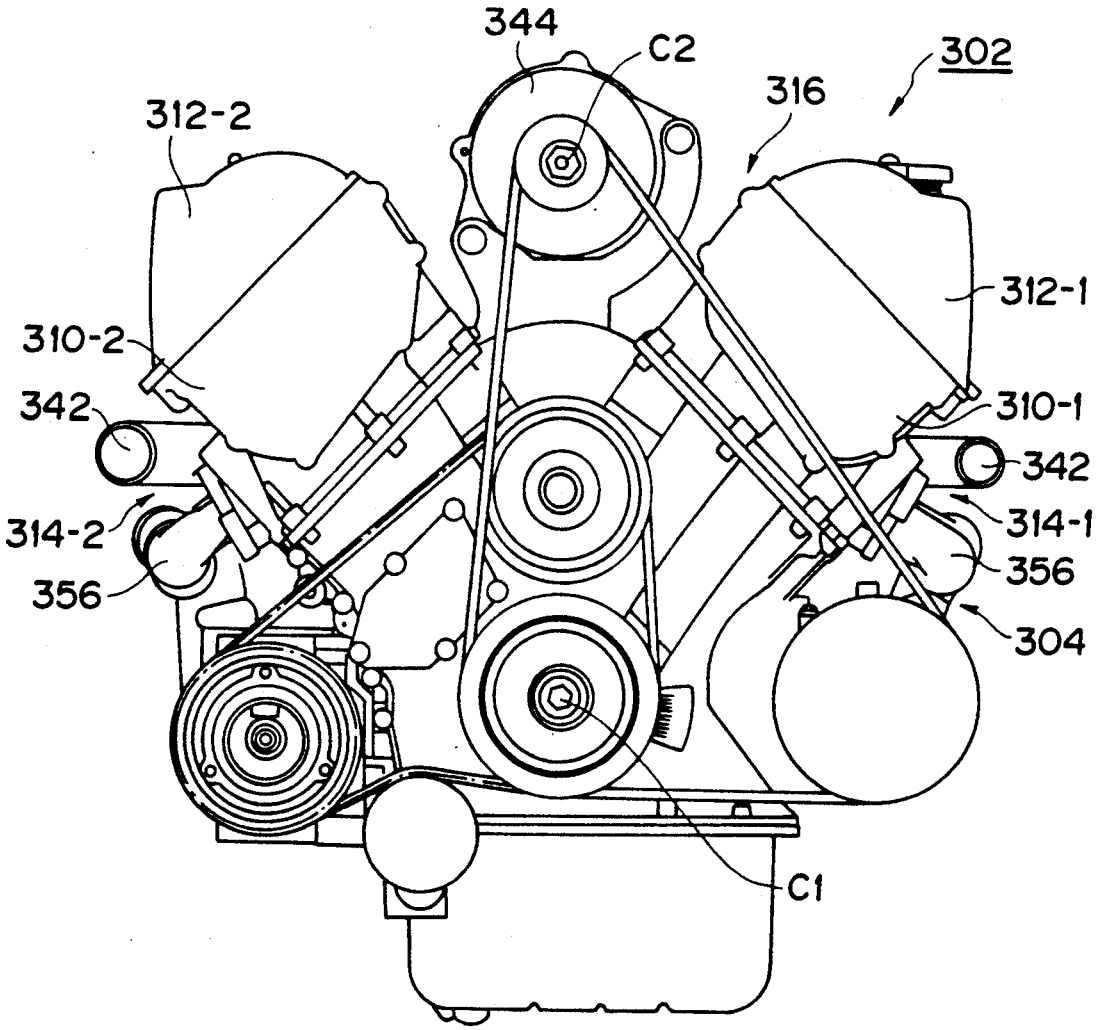
FIG. 9 PRIOR ART
FIG. 9 is a schematic front view of another prior art engine.

FIGS. 6 and 7 show a third embodiment of the invention. In FIG. 7, the numeral 402 denotes a V-engine, and the numeral 404 denotes a cylinder block. In this V-engine 402, a bearing cap 406 is attached to a lower portion of the V-cylinder block 404 and an oil pan 408 is attached to a lower portion of this bearing cap 406.

First and second cylinder heads 410-1 and 410-2, and first and second cylinder head covers 412-1 and 412-2, are placed on upper surface portions of the cylinder block 404. The first cylinder head 410-1 and the first cylinder head cover 412-1 are disposed to one side (right-hand side of FIG. 7) of the V-engine 402, while the second cylinder head 410-2 and the second cylinder head cover 412-2 are disposed to the other side (left-hand side of FIG. 7) of the V-engine 402. By thus placing the first and second cylinder heads 410-1 and 410-2, the first and second cylinder banks 414-1 and 414-2 are arranged in a V-shape. Between the first and second cylinder banks 414-1 and 414-2, a space or open zone 416 is formed.

A crankshaft 418 is rotatably supported by both the cylinder block 404 and the bearing cap 406 in the forward and rearward directions of the V-engine 402. An end portion of the crankshaft 418 on the forward side of the cylinder block 404 slightly projects from the front end face of the cylinder block 404 in order to mount a crank pulley 420 thereon.

A power steering pump 422 is mounted on one side (right-hand side of FIG. 7) of the cylinder block 404. This power steering pump 422 is driven by the rotation of a power steering shaft 426 to which a power steering pulley 424 is fixed.

An air compressor 428 is mounted to the other side (left-hand side of FIG. 7) of the cylinder block 404. This air compressor 428 is driven by the rotation of a compressor shaft 432 to which a compressor pulley 430 is fixed.

Further, a water pump 434 is mounted on the cylinder block 404 above the crank pulley 420. The water pump 434 is driven by the rotation of a water pump shaft 438 to which a water pump pulley 436 is fixed.

Furthermore, an intake manifold 440 extends across the first and second cylinder heads and is disposed in the space portion 416 between the first and second cylinder banks 414-1 and 414-2.

A cooling water pipe 442 is disposed between the cylinder block 404 of V-engine 402 and the intake manifold 440. A generator 444 is disposed in such a manner as to be laterally offset with respect to the center C1 of the V-engine 402. The cooling water pipe 442 is taken out through a gap portion 446 provided by the lateral offsetting of the generator 444.

More specifically, the generator 444 is disposed in the space portion 416. The center C2 of the generator 444 is laterally offset with respect to a vertical plane through the center Cl of the V-engine 402 in such a manner as, for example, by being offset to one side (right-hand side of FIG. 7) of the V-engine 402. The gap 446 is provided between the intake manifold 440 and the generator 444. First and second opening portions 442-1 and 442-2 of the cooling water pipe 442 are disposed between the cylinder block 404 and the intake manifold 440 and are taken out through this gap 446.

The generator 444 is driven by the rotation of a generator shaft 450 to which a generator pulley 448 is fixed.

The crank pulley 420, the power steering pulley 424 and the generator pulley 448 have a first driving belt 452 wound thereon. Similarly, the crank pulley 420, the compressor pulley 430 and the water pump pulley 436 have a second driving belt 454 wound thereon.

The numeral 456 denotes an exhaust manifold.

The operation will be described next.

When the V-engine 402 is assembled, the center C2 of the generator 444 is laterally offset with respect to an imaginary vertical plane passing through the center Cl of the V-engine 402 toward one lateral side of the V-engine 402.

The gap 446 is provided between the intake manifold 440 and the generator 444, and the first and second opening portions 442-1 and 442-2 of the cooling water pipe 442 are disposed between the cylinder block 404 of the V-engine 402 and the intake manifold 440 and are taken out through this gap 446.

The V-engine 402 can be formed compactly and the assembling performance of the V-engine 402 can be improved, which is not only advantageous in practical use but also makes it possible to shorten the length of the cooling water pipe 442.

Further, since the cooling water pipe 442 is disposed in the space portion 416 and this cooling water pipe 442 is disposed away from the exhaust manifold 456, there is no transmission of heat from the exhaust manifold, the cooling efficiency of the cooling water can be maintained favorably, which is advantageous in practical use.

Further, since the cooling water pipe 442 is disposed in the space portion 416 formed between the first and second cylinder banks 414-1 and 414-2 of the V-engine 402, the possible breakage of the cooling water pipe 442 at the time the V-engine 402 is assembled can be prevented, the service life of the cooling water pipe 442 can be prolonged, the cost of the V-engine 402 can be lowered and thus economically advantageous results are obtained compared with the conventional arrangement.

As described in detail, according to the present invention, the cooling water pipe is disposed between the cylinder block of the V-engine and the intake manifold. The auxiliary machine is disposed in such a manner as to be laterally offset with respect to the center of the V-engine. The cooling water pipe is taken out through a gap portion created by the lateral offsetting of the auxiliary machine. Accordingly, the V-engine can be formed compactly and the ease of assembling the V-engine can be improved, which is not only advantageous in practical use but also makes it possible to shorten the length of the cooling water pipe.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a cooling water system for a V-engine having a radiator, a water pump for supplying cooling water to the cylinder heads of the engine, a cooling water intake pipe connected between the radiator and the water pump, a cooling water discharging pipe connected to return cooling water to said radiator from each cylinder head of said engine, said intake and discharging pipes being disposed at an upper portion of said V-engine, and an intake manifold disposed close to said intake and discharging pipes, said manifold being provided with an arrangement of branch pipes, the improvement comprising: said branch pipes of said intake manifold being inclined at a predetermined angle so as to be non-perpendicular to the centerline of the engine crankshaft, said cooling water intake pipe and said cooling water discharging pipe being disposed within the space defined by said inclined arrangement of said branch pipes.

2. A cooling water system as claimed in claim 1 in which said manifold is disposed above the crankshaft of said engine in the spaced defined between the cylinder banks of said engine, said branch pipes of said manifold lie in a side-by-side array in a substantially horizontal plane, said branch pipes defining a zone at one end of the array, which said zone is open in a vertical direction, and said cooling water intake pipe and said cooling water discharging pipe extending upwardly through said zone from below said array of branch pipes to a location above said array of branch pipes.

3. A V-engine as claimed in claim 2, in which said intake and discharging pipes are integrally formed as one unit.

* * * * *